US005674570A

United States Patent [19]

Fouvet

[11] Patent Number: 5,674,570

[45] Date of Patent: Oct. 7, 1997

[54] PROCESS AND INSTALLATION FOR PROJECTING A COATING PRODUCT

[75] Inventor: Michel Fouvet, Champagnier, France

[73] Assignee: Sames S.A., Meylan, France

[21] Appl. No.: 382,636

[22] Filed: Feb. 2, 1995

[30] Foreign Application Priority Data

Feb. 2, 1994 [FR] France ..... 94 01320

[51] Int. Cl.[6] ..... B05D 7/00

[52] U.S. Cl. ..... 427/421; 427/425; 118/321; 118/322; 118/323; 118/326

[58] Field of Search ..... 427/421, 425; 118/321, 322, 323, 326

[56] References Cited

U.S. PATENT DOCUMENTS

| | | | |
|---|---|---|---|
| 3,865,525 | 2/1975 | Dunn | 118/321 |
| 3,952,699 | 4/1976 | Durr et al. | 118/321 |
| 4,931,322 | 6/1990 | Yamamoto et al. . | |
| 5,240,745 | 8/1993 | Yamamoto et al. . | |

FOREIGN PATENT DOCUMENTS

| | | |
|---|---|---|
| 3430531 | 2/1986 | Germany . |
| 2190312 | 11/1987 | Germany . |
| 2 227 189 | 7/1990 | United Kingdom . |

OTHER PUBLICATIONS

French Search Report, Dec. 13, 1994.

*Primary Examiner*—Michael Lusignan
*Assistant Examiner*—David M. Maiorana
*Attorney, Agent, or Firm*—Loeb & Loeb LLP

[57] ABSTRACT

A process for spraying a coating product composed of: mounting a sprayer on a movable support member of a spraying machine; providing an object having a plurality of surfaces which surfaces include first and second surfaces which are oriented at least approximately vertically during spraying and are angled relative to one another, and a third surface which is oriented at least approximately horizontally during spraying; in a first spraying step, spraying the product onto at least the first surface from a sprayer while displacing the sprayer past the first one of the surfaces and while the first surface is oriented at least approximately vertically; rotating the object about a vertical axis after the first spraying step; and, in a second spraying step, after the rotating step, spraying the product onto at least the second surface from the sprayer while displacing the sprayer past the second one of the surfaces and while the second surface is oriented at least approximately vertically, wherein the product is sprayed onto the third surface during one of the spraying steps. An installation is constructed to spray a coating product according to the above-described process,

12 Claims, 4 Drawing Sheets

PROCESS AND INSTALLATION FOR PROJECTING A COATING PRODUCT

BACKGROUND OF THE INVENTION

The invention relates to a process and installation for projecting, or spraying, a coating product onto objects carried by a conveyer, such as, for example, the bodies of automotive vehicles.

On a production line according to the prior art, car bodies are conveyed by a conveyor and the spraying installation is constituted by several spraying machines, called lateral machines, intended to coat the sides of the body, along with a machine, called an overhead, or roof, machine, composed of two uprights supporting a beam which itself carries a sprayer intended to coat the front, the hood, the roof, the trunk and the rear of the body. Such an installation is generally composed of three lateral devices, or machines, on each side and one overhead machine. In the case of car bodies for industrial vehicles, such as large dimension cabs of trucks, the number of lateral devices must often be increased.

SUMMARY OF THE INVENTION

It is an object of the present invention to effect an optimal utilization of the overhead machine which permits elimination of the lateral machines of the prior art. The cost of construction of the installation is thus reduced, as is the space required by the installation. In effect, the space previously required for the lateral machines is made available, which makes possible a reduced size and volume for the spraying enclosure, more compact ventilation and fire protection systems and, finally, a supporting structure which is lighter and thus less costly.

Another object of the invention is to provide a process and installation for spraying a coating product onto an object being conveyed by a conveyer which undergoes a discontinuous movement, wherein a rotation about a vertical axis is imposed on the object between two coating phases, or operations, with at least one sprayer carried by the beam of an overhead machine, the phases corresponding to the coating of different surfaces of the object.

The utilization of an overhead machine according to the invention is particularly advantageous in the case of objects which have a generally parallelepiped shape, such as the bodies of vehicles. In effect, there exist five well-defined surfaces, in two more or less perpendicular groups, to be coated, these surfaces possibly being discontinuous like those formed by the hood, the roof and the trunk of a sedan.

The invention also concerns a process and installation for spraying a coating product by means of a sprayer wherein the spraying of the coating product, in a spraying booth, during movements of the sprayer parallel to the dominant current of air established in the booth takes place during movements of the sprayer in the direction opposed to the dominant air current.

The invention concerns in addition an installation for spraying a coating product comprising an overhead machine characterized in that it includes means for effecting linear transport of the objects to be coated, serving to interrupt the travel of the objects and a pivotal support adapted to cause them to undergo at least one rotation of about 90°.

The invention finally concerns an installation for spraying a coating product in a booth equipped with ventilation means adapted to establish a dominant air current in the booth, wherein the installation includes means for activating at least one sprayer during its movements in a direction opposite to the direction of the dominant air current.

The invention will be better understood and other advantages thereof will appear more clearly from the following description of an embodiment of an installation for spraying a coating product according to the invention, given uniquely by way of example and presented with reference to the attached drawings.

DESCRIPTION OF THE PREFERRED EMBODIMENTS

Figure 1:
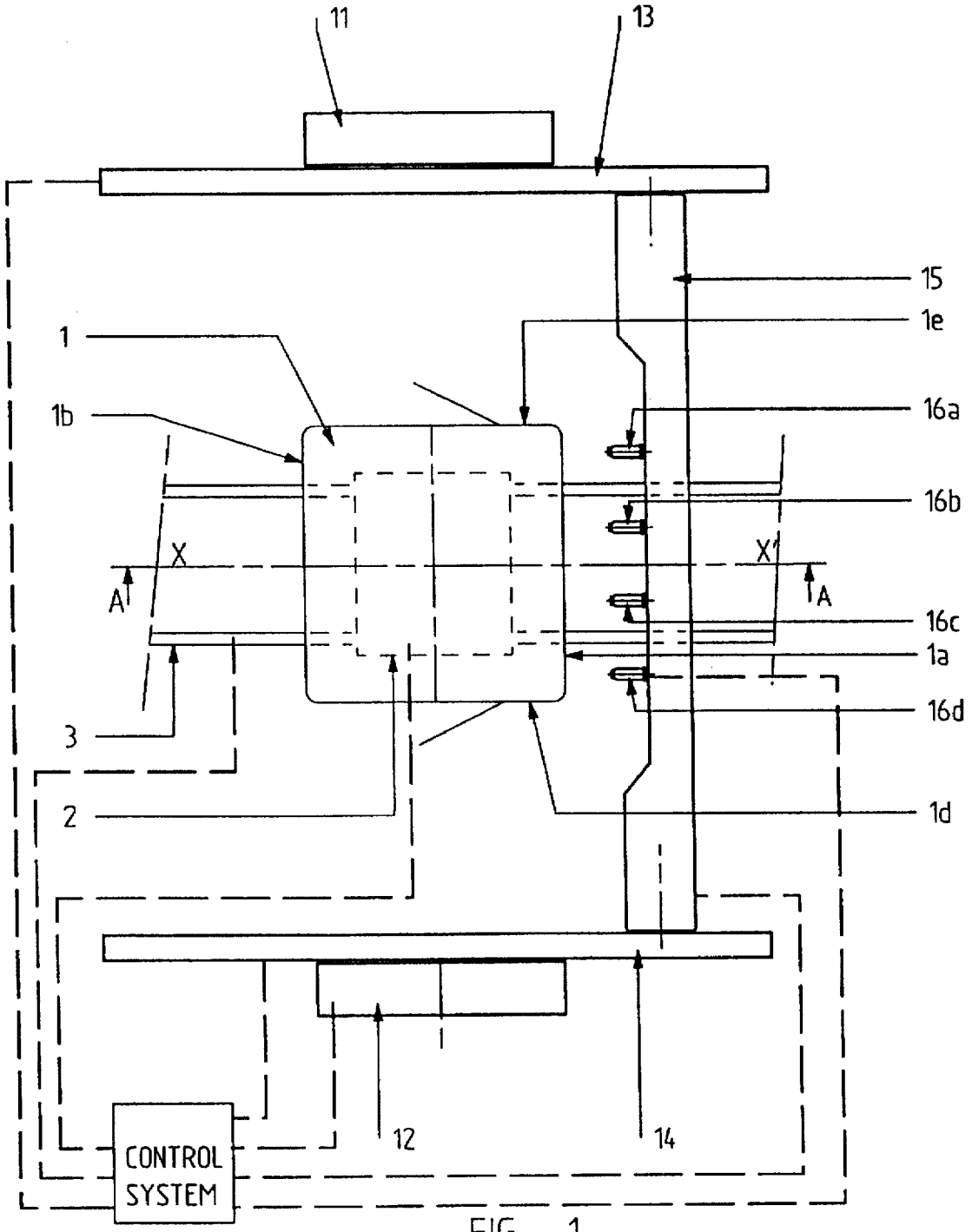
FIG. 1 is a simplified pictorial plan view of a spraying installation according to the invention.
Figure 2:
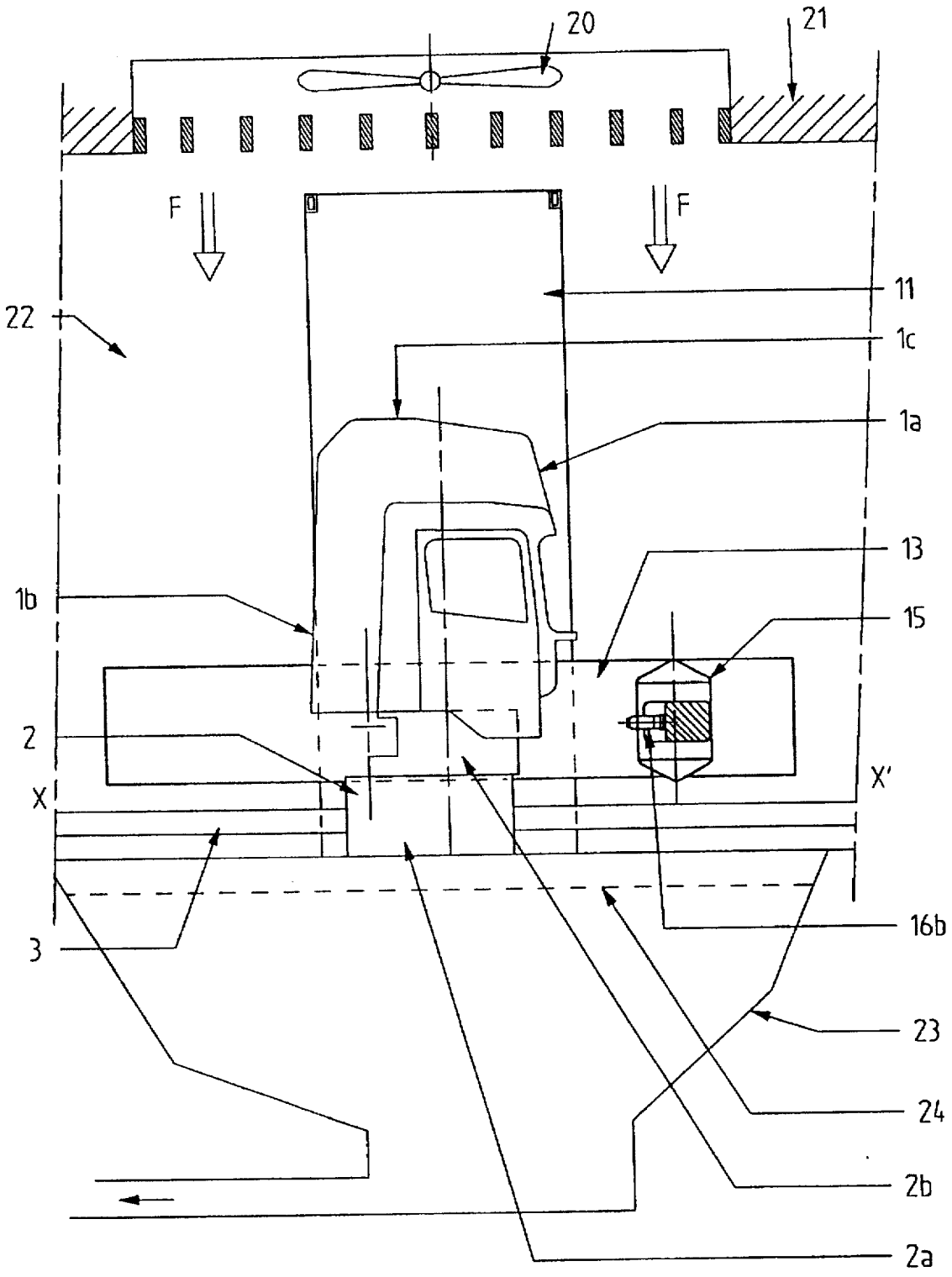
FIG. 2 is a pictorial cross-sectional view taken along the line A—A of FIG. 1.

Referring to FIGS. 1 and 2, the illustrated installation is intended to coat the bodies of automotive vehicles, such as, for example, a truck cab 1. Each body has five faces to be coated, namely a front 1*a*, a rear 1*b*, a roof 1*c*, a right side 1*d*, and a left side 1*e*. Each body is carried on a respective carriage 2 displaced along a defined path in the direction of axis XX' by means of an appropriate conveyor system 3. Conveyor system 3 is of the discontinuous movement type, which signifies that each body 1 will be brought to a halt during the coating operations.

An overhead machine is constituted by two uprights 11 and 12, each carrying a respective carriage 13, 14. Carriages 13 and 14 support a beam 15 and allow for displacement of beam 15 along the axis XX'. Beam 15 carries four sprayers 16*a*, 16*b*, 16*c*, and 16*d* for spraying the coating product, for example rotatable sprayers for a powder coating product.

As can be seen in FIG. 2, body 1 is supported by a carriage 2. Carriage 2 is formed of a fixed housing 2*a* and a turret 2*b* mounted to pivot about a vertical axis.

Beam 15 is movable vertically by a movement of carriages 13 and 14 along uprights 11 and 12 by the action of motors, for example electric motors, and drive belts which are conventional in the art. Vertical movement of carriages 13 and 14 permits beam 15 to sweep over the height of objects to be coated. Ventilation of the spraying enclosure, or booth, in particular extraction of coating products which are not deposited on body 1, is effectuated by a supply of air, such as, for example, a ventilator 20 situated in the roof 21 of spraying booth 22 and a suction hood 23 formed beneath the floor of the spraying booth 22. A dominant current of air which flows vertically from the top to the bottom, represented by arrows F, is thus created in spraying booth 22.

Figure 3:
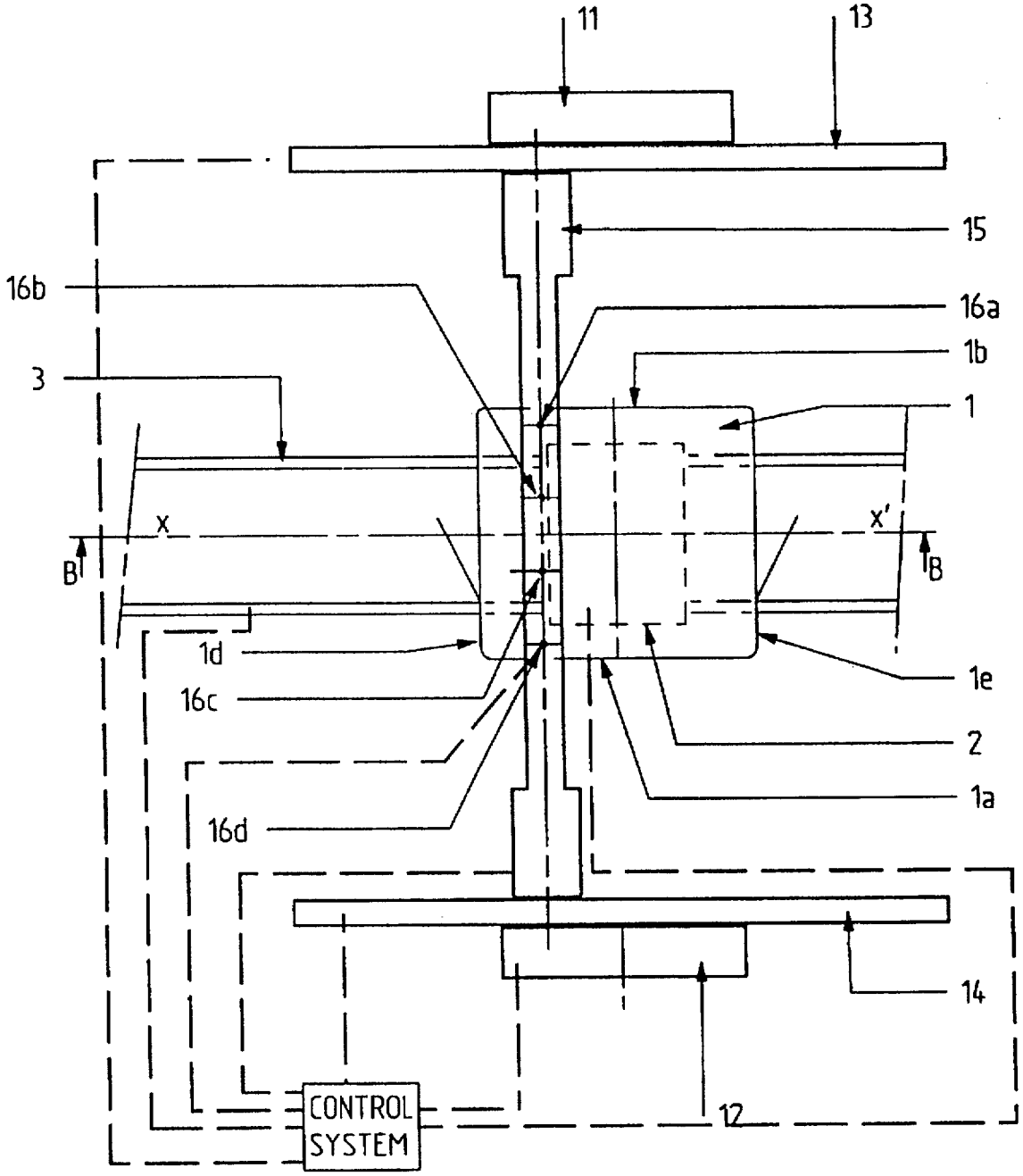
FIG. 3 is a view similar to that of FIG. 1 showing the installation in an operating phase different than that of FIG. 1.
Figure 4:
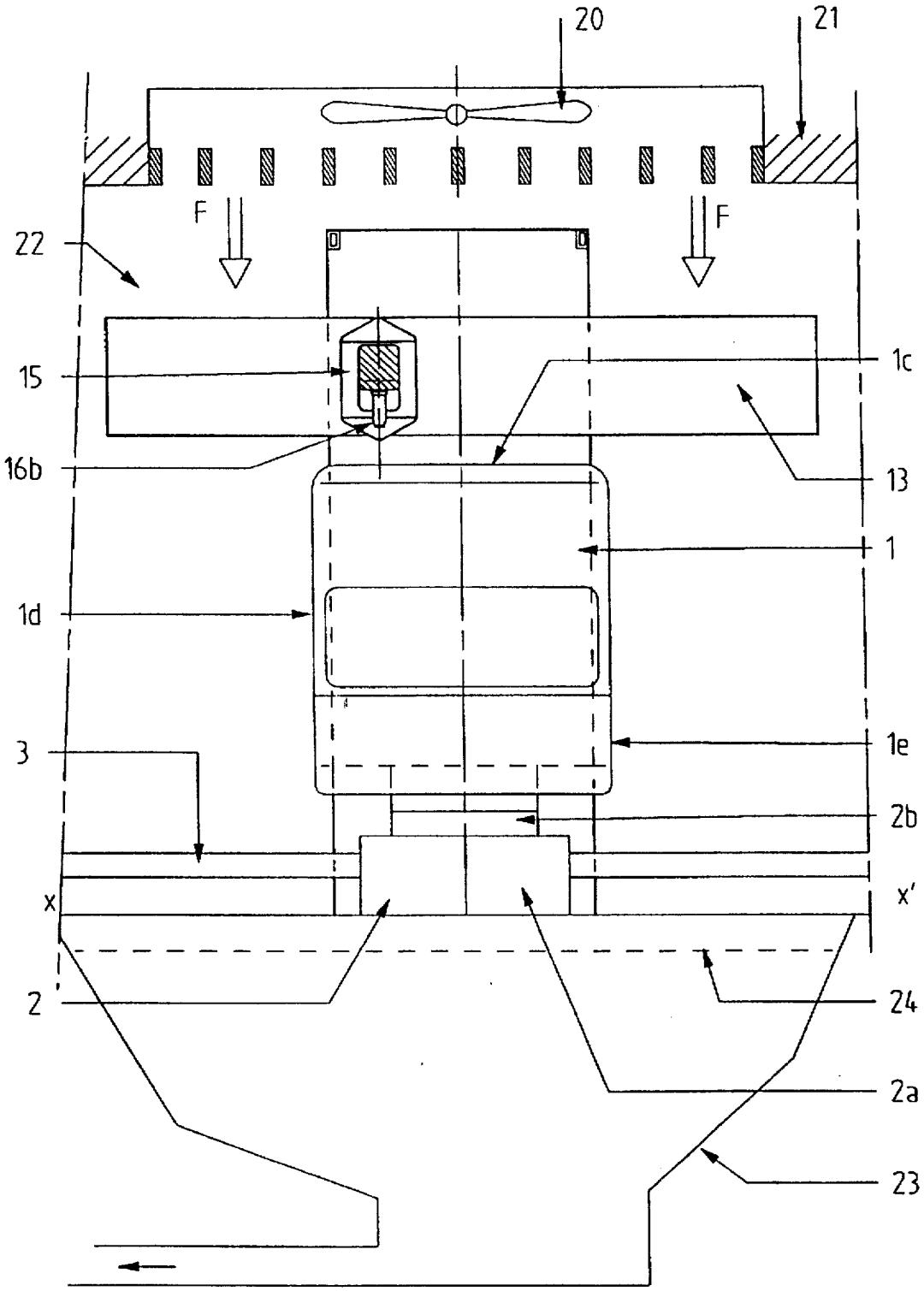
FIG. 4 is a view similar to that of FIG. 2 taken along the line B—B of FIG. 3.

FIGS. 3 and 4 are views similar to those of FIGS. 1 and 2, respectively, and identical elements bear the same reference numerals. FIGS. 3 and 4 differ from FIGS. 1 and 2 only in that the two sets of figures illustrate respectively different operating phases, as will be described in greater detail below. The operation of the installation will now be described.

Beam 15 is shown in FIG. 2 at the lowest point of its travel path. Its rising movement, combined with activation of sprayers 16, allows front surface 1*a* of body 1 to be coated. Beam 15 is then displaced, with sprayers 16 deactivated, in order to be positioned opposite rear face 1*b* of body 1. During this displacement, beam 15 is rotated so that the cutlet nozzles of sprayers 16 are directed toward rear face 1*b* and beam 15 is again brought to the lowest point in its travel path. Spraying then begins again while beam 15 undergoes a vertical ascending movement.

In the configuration illustrated in FIGS. 1 and 2, the installation is able to coat front face 1*a* and rear face 1*b* of body 1, as well as roof 1*c*, if desired.

According to an advantageous feature of the invention, spraying takes place during movement of beam 15 parallel to the direction of flow of the air current F, but in the direction, or sense, which is opposite to the sense of arrows F. Thus, during each spraying phase, or procedure, the sprayers will always be moving away from the overspray, i.e., the sprayed product which is not deposited on body 1. In effect, sprayers 16 will be moving upwardly, while the overspray is being conveyed downwardly by the ventilation air stream. Thus, sprayers 16 and beam 15 are protected against soiling, and as a result maintenance of the installation is facilitated.

FIGS. 3 and 4 illustrate a second operating state which is established by rotating turret 2*b*, and thus body 1, through an angle of about 90° about a vertical axis. After this movement has been effected, the right side 1*d* and the left side 1*e* of body 1 are brought into position to be sprayed by sprayers 16.

In the condition shown in FIG. 4, beam 15 is shown at the upper end of its travel path, in a position for coating roof 1*c* of body 1. This coating could also take place when body 1 is in the position shown in FIGS. 1 and 2.

Right side 1*d* of body 1 is first coated from the bottom to the top, for reasons explained above. Then left side 1*e* and roof 1*c* are coated. Again, left side 1*e* is coated while beam 15 travels upwardly. It will be noted that while roof 1*c* is being coated, the ventilating air stream also carries overspray away from beam 15 and sprayers 16.

Thus, the five faces 1*a*–1*e* of body 1, other than the bottom surface, are coated by a single overhead machine. The uniformity of the resulting appearance is improved because use is made of a single supply of coating product for the machine, instead of the individual supplies normally provided for the lateral machines and the overhead machines.

Before leaving the spraying enclosure, or booth, body 1 could possibly undergo a second rotation by 90° in the opposite direction from the first rotation, by rotating turret 2*b*, in order to be placed back in its initial position for the next fabrication step.

The embodiment described above is equipped with rotatable sprayers for a powder product. However, it can also be practiced with any other types of sprayers using a liquid or powder coating product.

As further shown in FIG. 1, the overhead machine according to the invention is equipped, in accordance with conventional practice, with a computer-based control system connected for controlling the movement of conveyor system 3, rotation of turret 2*b*, movement of carriages 13 and 14 and of beam 15 and activation and deactivation of sprayers 16.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A process for spraying a coating product comprising:

a) mounting a sprayer on a movable support member of a spraying machine;

b) providing an object having a plurality of surfaces which surfaces include first and second surfaces which are oriented at least approximately vertically during spraying and are angled relative to one another, and a third surface which is oriented at least approximately horizontally during spraying;

c) in a first spraying step, spraying the product onto at least the first surface from a sprayer while displacing the sprayer past the first one of the surfaces and while the first surface is oriented at least approximately vertically;

d) rotating the object about a vertical axis after said first spraying step; and e) in a second spraying step, after said rotating step, spraying the product onto at least the second surface from the sprayer while displacing the sprayer past the second one of the surfaces and while the second surface is oriented at least approximately vertically, wherein the product is sprayed onto the third surface during one of the spraying steps.

2. A process as defined in claim 1 wherein the second surface is substantially perpendicular to the first surface and said step of rotating is performed to rotate the object through an angle of 90°.

3. A process as defined in claim 2 wherein the object has front and rear surfaces which are coated during said first spraying step and two side surfaces which are coated during said second spraying step.

4. A process as defined in claim 1 wherein said spraying steps are performed in a spraying enclosure, said process further comprising establishing a dominant air current in the enclosure, which air current flows in a first direction, and wherein at least one of said spraying steps is performed while moving the sprayer in a second direction opposite to the first direction.

5. A process as defined in claim 4 wherein said spraying steps are performed while moving the sprayer in the second direction for coating all object surfaces which are substantially parallel to the first and second directions.

6. A process as defined in claim 5 wherein the first direction is downward.

7. A process as defined in claim 1 wherein the object is a vehicle body.

8. A process as defined in claim 1, further comprising:

f) establishing a dominant air current in the enclosure, which air current flows in a first direction; and g) spraying the product onto at least one of the surfaces from a sprayer while displacing the sprayer past the at least one of the surfaces in a second direction opposite to the first direction.

9. An installation for spraying a coating product onto objects, said installation comprising:

an overhead spraying machine; and conveyor means for conveying objects to be coated along a horizontal conveying path through said machine, said conveyor means comprising means for halting movement of each object through said machine and for rotating each object by about 90° about a vertical axis when movement of the object is halted, wherein said machine comprises:

a beam;

at least one sprayer supported by said beam; and displacement means coupled to said beam for displacing said beam in translation along vertical paths and along a horizontal path parallel to the conveying path.

10. An installation as defined in claim 9 wherein the coating product is a powder or liquid.

11. An installation as defined in claim 9, further comprising:

a) a spraying enclosure;

b) means for establishing a dominant air current in the enclosure, which air current flows in a first direction; and c) means for spraying the product onto the at least one surface from a sprayer while displacing the sprayer past the first one of the surfaces in a second direction opposite to the first direction.

12. An installation for spraying a coating product onto a plurality of surfaces of an object, which surfaces include first and second surfaces which are oriented at least approximately vertically during spraying and are angled relative to one another, and a third surface which is oriented at least approximately horizontally during spraying, said installation comprising:

a) a spraying machine having a movable support member and a sprayer mounted on said movable support member;

b) support means for supporting the object for rotation about a vertical axis;

c) control means coupled to said machine and said support means for spraying the product from the sprayer onto at least the first surface in a first spraying step while displacing the sprayer past the first surface and the first surface is oriented at least approximately vertically, then rotating the object about the vertical axis and then spraying the product from the sprayer onto the second surface while displacing the sprayer past the second surface and the second surface is oriented at least approximately vertically, the product being sprayed onto the third surface during spraying of at least one of the first and second surfaces;

d) a spraying enclosure; and e) means for establishing a dominant air current in the enclosure, which air current flows in a first direction, wherein said control means are operative for spraying the product from the sprayer onto at least the first and second surfaces while displacing the sprayer past the first and second surfaces in a second direction opposite to the first direction.

* * * * *